US005503434A

United States Patent [19]

Gunn

[11] Patent Number: 5,503,434

[45] **Date of Patent: * Apr. 2, 1996**

[54] CREDIT/SERVICE CARD WITH EXPANDED SURFACE AREA

[76] Inventor: Robert T. Gunn, 360 E. 65th St., New York, N.Y. 10021

[ * ] Notice: The portion of the term of this patent subsequent to Jul. 30, 2012, has been disclaimed.

[21] Appl. No.: 290,341

[22] Filed: Aug. 12, 1994

Related U.S. Application Data

[63] Continuation-in-part of Ser. No. 201,930, Feb. 24, 1994, abandoned, which is a continuation of Ser. No. 922,145, Jul. 30, 1992, Pat. No. 5,308,121.

[51] Int. Cl.[6] ..... B42D 15/00

[52] U.S. Cl. ..... 283/67; 283/99; 283/100; 283/106; 283/900; 283/904

[58] Field of Search ..... 283/99, 67, 100, 283/106, 900, 904

[56] References Cited

U.S. PATENT DOCUMENTS

| | | | |
|---|---|---|---|
| 4,632,428 | 12/1986 | Brown . | |
| 4,950,258 | 8/1990 | Kawai et al. | 264/230 X |
| 4,984,683 | 1/1991 | Eller | 283/900 X |
| 5,026,452 | 6/1991 | Kodai | 283/904 X |
| 5,171,039 | 12/1992 | Dusek | 283/900 X |
| 5,189,110 | 2/1993 | Ikematu et al. | 264/230 X |
| 5,211,424 | 5/1993 | Bliss | 283/904 X |
| 5,215,334 | 6/1993 | Presson et al. | 283/904 X |
| 5,308,121 | 5/1994 | Gunn | 283/99 |

FOREIGN PATENT DOCUMENTS

| | | | |
|---|---|---|---|
| 2563162 | 4/1984 | France . | |
| 2640549 | 6/1990 | France | 283/904 |
| 2235412 | 6/1991 | United Kingdom | 283/106 |

*Primary Examiner*—Frances Han
*Attorney, Agent, or Firm*—Curtis, Morris & Safford

[57] ABSTRACT

A credit/service card with expanded surface area comprises a first card member, a second card member and a hinge connecting the two card members. The credit/service card also comprises a fastener for holding the first and second card member together when the credit/service card is in the closed position.

12 Claims, 20 Drawing Sheets

CREDIT/SERVICE CARD WITH EXPANDED SURFACE AREA

This application is a continuation-in-part of application Ser. No. 08/201,930, filed Feb. 24, 1994, now abandoned, which is a continuation of application Ser. No. 07/922,145, filed Jul. 30, 1992, incorporated herein by reference, now U.S. Pat. No. 5,308,121 issued May 3, 1994.

BACKGROUND OF THE INVENTION

The present invention relates to credit/service cards and methods of use of credit/service cards. In particular, the present invention relates to credit/service cards with expanded surface area for the recording and displaying of information.

In today's world credit/service cards are in wide use. It is estimated that a typical American household may have as many as three or four different credit/service cards. Credit/service cards may be used for a variety of purposes including purchasing goods or services without using cash, charging a telephone call at a public telephone, or withdrawing money from, or depositing money into ones bank account.

Referring to FIGS. 1 and 2, there is depicted a prior art, or conventional, credit/service card 30. The credit/service card may contain on its front surface 32 various dam including an account number 34, the holder's name 36, the expiration date 38, one or more reference numbers 40, 42, the name of the issuing company 44, and a logo or indication of the type of card 46. Some of this information may be embossed on the card's face. The credit/service card may also contain a hologram 48 to prevent tampering with or unauthorized duplication of the credit/service card. The back 50 of the credit/service card 30 may contain a variety of other information (including a photograph of the card holder) in any open space available 52. The credit/service card also may have a magnetic strip 54 that contains magnetically recorded information which is able to be read by magnetic card readers, telephones, and/or ATM machines at various locations for verification of credit, account balance/information, validity, or possibly obtaining other information about the user. The back of the credit/service card 38 may also contain a signature strip 56 with the holder's signature. The back surface 50 of the credit/service card may contain various important data 52, for example the account number, rules relating to use of the card, additional logos of the card type, telephone numbers and/or addresses to report loss of the card, telephone numbers and/or addresses for billing inquiries, other telephone numbers needed by the user, and/or instructions for use of the card.

A standard size credit/service card has a length of about 3.375 inches, a width of 2.125 inches and a thickness of approximately 0.030± 10% inches. As can be seen this prior art credit/service card has only two faces or surfaces 32, 50 for the inclusion of information.

Similar credit/service cards are issued by telephone companies for charging telephone calls from remote locations. These cards may include some of the same elements, including the magnetic strip and the information on the front of the card. Additionally, the typical telephone charge card includes information on the back surface of the card for charging telephone calls and dialing information. In some public telephones, the user can slide the card through a slot in the telephone in order to charge calls on his telephone card. This type of telephone is capable of reading the magnetic strip, verifying the caller's credit/service, and charging the caller's account.

Typically, ATM machines use cards of the size and shape described for credit/service cards. These cards are used for allowing a user to withdraw money from, or deposit money into, and/or obtain balance information from her bank account. These cards may also be used to transfer money between accounts. As with the normal credit/service card, there is typically a magnetic strip placed along the back of the ATM card which is read upon placing the A.T.M. card into a bank teller machine. The bank teller machine may withdraw the card into the machine so that the card may totally disappear from the user's view while the transaction is being processed.

Increasingly, credit/service card companies are offering more and more services that can be charged on a single, credit/service card or services that are given complimentary for using the credit/service card. Some of these services may be termed "credit card enhancements" and may include for example, life/travel insurance, automobile servicing automobile rental insurance, and/or replacement of lost items that are purchased with the credit/service card. Credit/service cards issuers may offer a combination of services to be used with one card such as charging long-distance calls, automobile club membership, and at the same time charging typical items, for example retail store purchases, purchases of services, and restaurant purchases. Combining the functions and benefits of many different cards into a single card may alleviate the need to carry multiple cards.

Also, membership and other types of cards may be combined with conventional credit/service cards and a photograph of the holder may be added for identification purposes. For example, a card may double as a membership card and a credit card, or a telephone card and a credit card, or a store charge card and a credit card, or any combination or all of the above. In order to effectuate these multipurpose cards, more surface area is needed on the card for the printing of information, such as telephone numbers, instructions, photographs, and other items needed to use the offered services. The additional information my include "800" telephone numbers, instructions for or codes needed to use certain services, and other essential data.

The term "credit/service card" is understood to mean any type of card capable of being used for monetary transactions or identification. A credit/service card would include, but is not limited to, the following: a credit card (such as a standard credit card, a specific retail or wholesale store credit card, oil and gas credit card, and the like), a debit card (such as a card which draws funds directly from a bank or credit union checking, savings, or reserve account), a pre-paid transactional card (such as a commuter fare card, a photocopy machine card, a school or university cafeteria card, and the like), a membership or identification card (such as an airline frequent flyer card, a health club membership card, a wholesale store membership card, a personal identification card, a vehicle identification card, a high security area identification card, and the like), information cards (such as a medical information card, a personal information card, an instruction card, or the like), a personal photo holder card, or any card used in a similar manner to the above.

One solution to this problem might be to change the size and dimensions of the conventional credit/service card so that more information can be placed on the resultant expanded surface area. This solution may not be advantageous in that there exists hundreds of thousands of magnetic credit/service card readers at point of sale locations which read the magnetic strip by sliding the credit/service card through a slot in the credit/service card reader. Also, other equipment exists for other uses such as ATM machines and public telephones which may require a certain standard size card.

Typically, the merchant takes the card and runs it through a slot in a small machine that reads the magnetic strip, typically on the back surface of the credit/service card. In order to be able to be used in the machine, the credit/service card must be no greater than a predetermined maximum thickness so that it fits through the existing slot. Public telephones may have similar sized slots to read the card. And, as described above, ATM machines may withdraw the whole card into the machine for processing. Furthermore, current wallets and purses are made to hold conventional size credit/service cards. Therefore, it is highly desirable that any new type of credit/service card be able to fit and be read in the existing machines used for scanning and reading magnetic information on these cards.

Because of the increasing number of uses that a single credit/service card may have, a need exists for any improvement in the credit/service card to result in a product the same size as existing credit/service cards so that it may be read by existing machinery and held in existing holders and wallets, and which has the same dimensions as a typical credit/service card.

It is of course recognized that the dimensions of the card can vary according to the type of card and the machinery used for scanning and reading magnetic information on the card, as well as varying according to the dimensional standards of different countries.

It is an object of the present invention to provide a credit/service card with qualities that are desirable among credit/service cards generally and that is also able to have more printed, readable, material placed thereon.

It is a further object to provide a credit/service card containing an increased amount of surface readable information and which is still able to be used in the existing credit/service card equipment.

SUMMARY OF THE INVENTION

Generally, the above and other objects of the present invention are achieved by increasing the usable surface of the credit/service card by dividing the card's thickness in multiple layers. The layers of the card are folded with a hinge. Preferably the hinge is molded into the plastic or comprises a plastic or metal rivet A fastening means which holds the card closed is provided so that the user can carry the card as if it were a normal size credit/service card.

According to a first aspect of the invention, a credit/service card includes a first card member which defines a first layer and a second card member which defines a second layer. A hinge connects the first and second card members, and a fastener holds the first card member to the second card member when the credit/service card is in a closed position.

According to another aspect of the invention there is provided a method of using a credit/service card. A credit/service card is provided with first and second card members, the first card member is hinged to the second card member so that when the credit/service card is in a closed position the first card member is releasably fastened to the second card member. The credit/service card is used in a machine which reads conventional credit/service cards in a dosed position.

According to yet another aspect of the invention, a credit/service card includes at least a first card member which defines a first card member which defines a first layer and a second card member which defines a second layer. A hinge connects the first and second card members wherein the hinge includes a means for self-closing and/or self-securing the first and second card member in a closed position.

DETAILED DESCRIPTION OF THE PRESENTLY PREFERRED EMBODIMENTS

Figure 1:
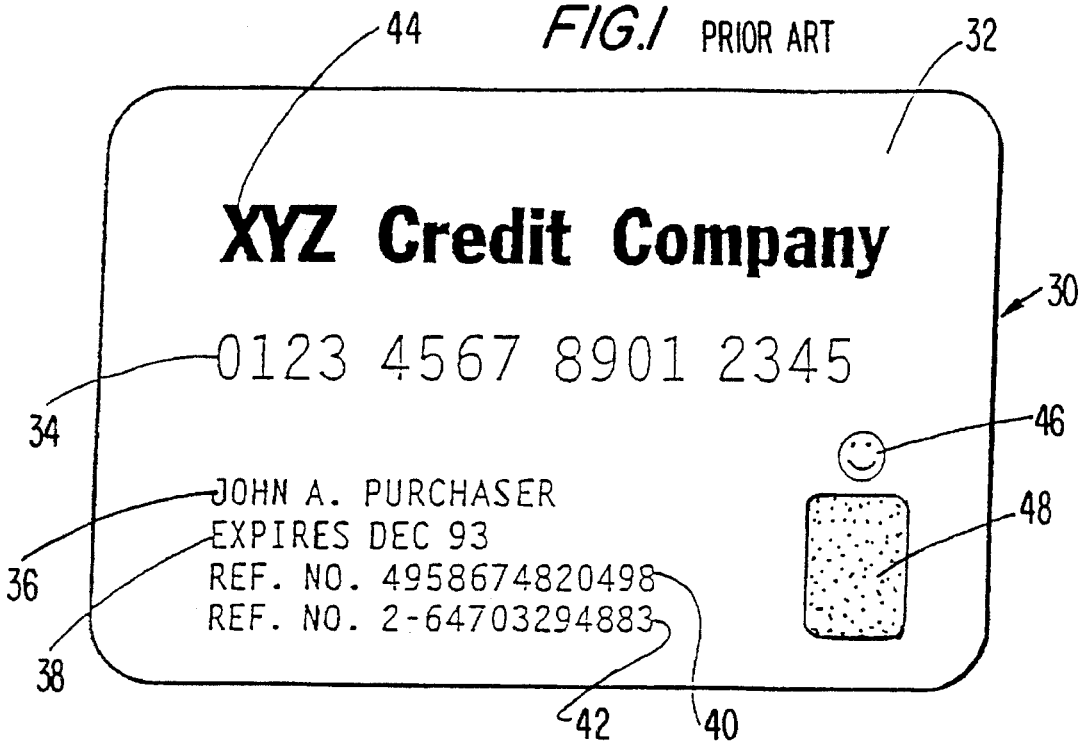
FIG.1 PRIOR ART
FIG. 1 shows a from view of a prior art credit/service card.
Figure 2:
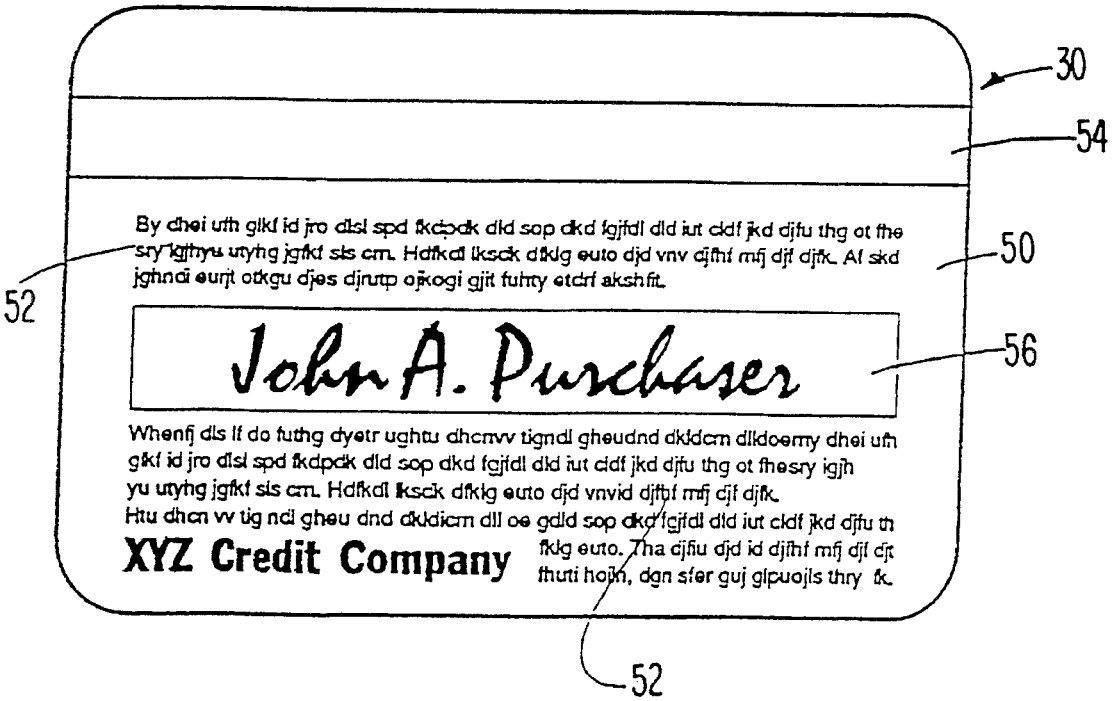
FIG.2 PRIOR ART
FIG. 2 shows the back view side of the prior art credit/service card of FIG. 1.
Figure 3:
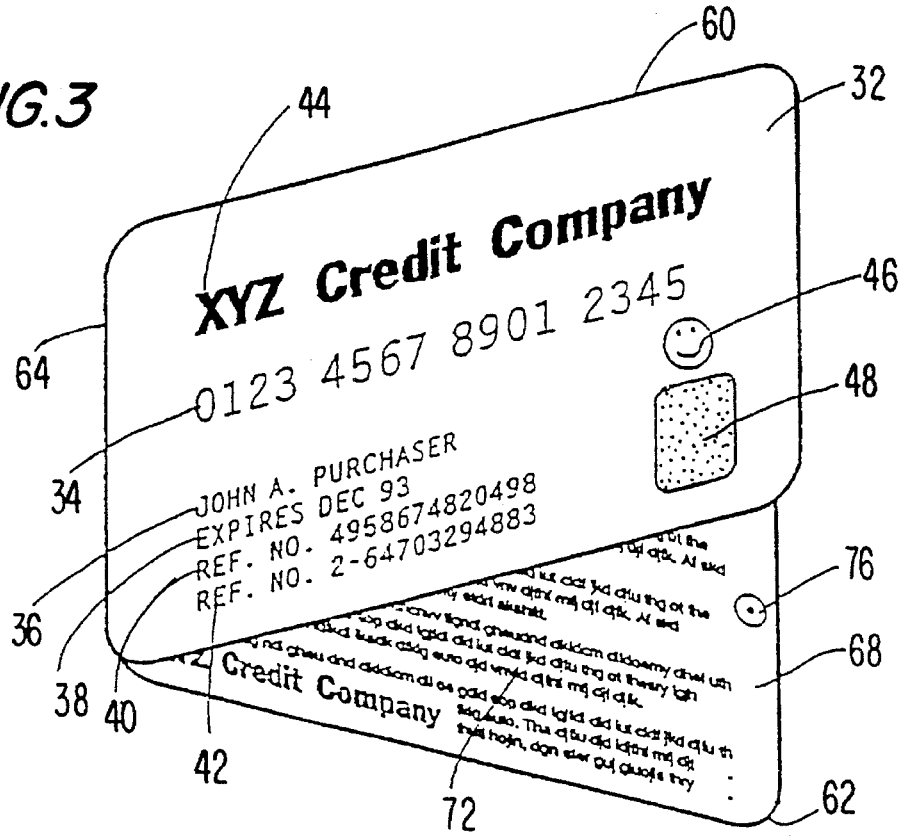
FIG. 3 shows an embodiment of the present invention wherein two card members are provided.
Figure 4:
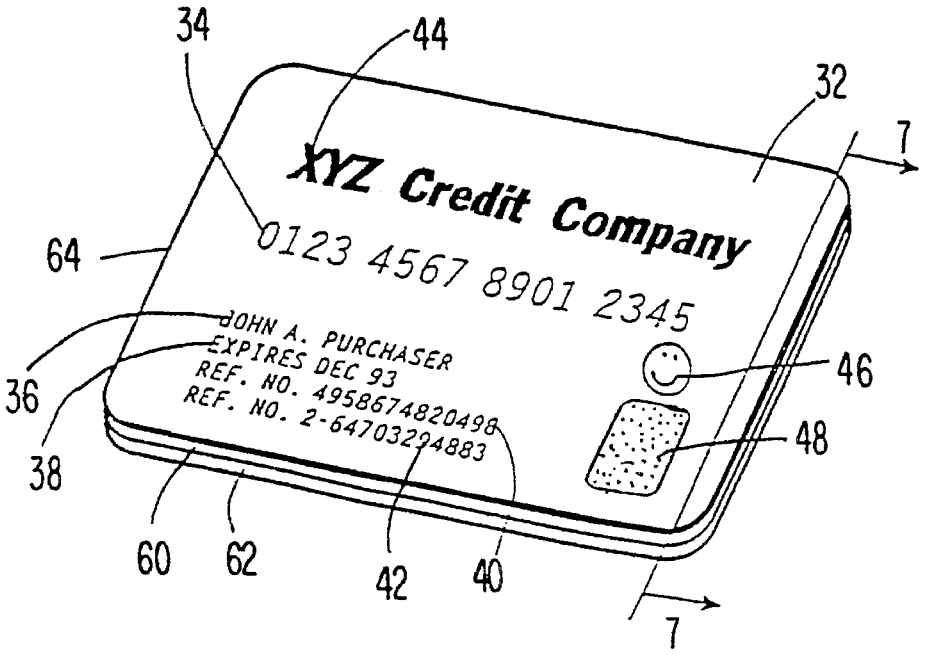
FIG. 4 shows the embodiment of FIG. 3 in a closed position.
Figure 5:
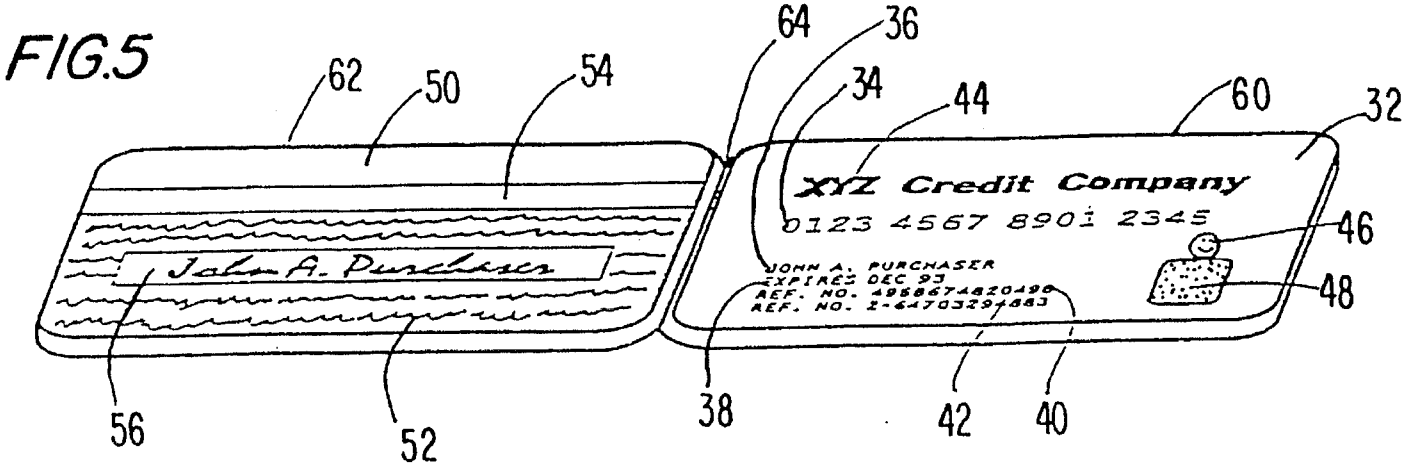
FIG. 5 shows the outside portion of the embodiment of FIG. 3 in a spread open, flat position.
Figure 6:
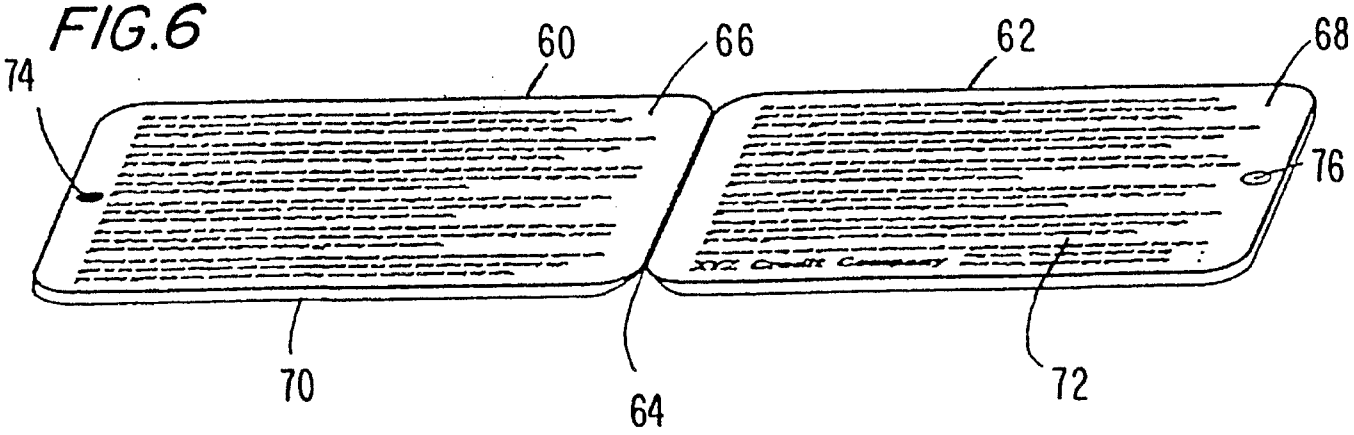
FIG. 6 is a back view of the embodiment shown in FIG. 5 showing the inside portion of the embodiment of FIG. 3 in a spread open, flat position.

Each of the embodiments described below has two outside surfaces, a front 32 and a back 50 when the card is in the closed or folded position. The information contained on these surfaces 32, 50 may be similar to that on the prior art, or conventional, card. On all of the embodiments described below, the surface 32 my contain, for example, an account number 34, the holder's name 36, the expiration date 38, reference numerals, 42, 40, a card logo 46, and a hologram 48, while the back of the card may contain, for example, a magnetic strip 54, a signature strip 56, and additional information 52. These features will be labeled with like numbers in the embodiments described below. As used herein, the term "credit/service card" encompasses traditional credit cards and service cards and also encompasses charge cards, automatic teller machine ("ATM") cards, telephone cards, service cards, and other cards used to charge goods and services, withdraw/transfer/deposit money, retrieve data, verify credit accounts, access services, and perform other tasks inherent in the use of such cards.

All of the embodiments described below have a thickness when they are in a dosed or folded position that does not exceed that of a conventional credit/service card. As described above, this thickness is approximately 0.030±0.003 inches. Furthermore, the length and width dimensions are approximately equal to that of a conventional credit/service card, i.e. a length of 3.375 inches and a width of 2.125 inches. These dimensions are chosen so that the credit/service card of the present invention may be used in existing conventional card readers, ATM machines, telephones, and the like.

Referring now to FIGS. 3 through 8, there is depicted a first embodiment of the present invention. As shown in these figures, the credit/service card has two member, a first member 60 and a second member 62. The members are attached together by a self hinge 64 which may be formed in a variety of ways. For example the two members 60, 64 may be cut or stamped from a single piece of material. A score line may then be made on the outside surface (combination of 32 and 50) of the material by conventional cutting techniques known to those skilled in the art. The score line may also be molded into the initial single piece of material, which may be made, for example, by injection molding, or extruding. Alternatively, a material used to imprint the two inner surfaces 66, 68, such as mylar, may be glued or pressed to the two members 60, 62, thereby forming a hinge.

As described above the front outside surface 32 of the first member 60 may contain the same information as a conventional credit/service card, and the back outside surface 50 of the second member 62 may also contain the same information contained on the back of a conventional credit/service card. On the back-inside surface 66 of the first member 60 there is room for additional writing 70 or other data. The same is true of the front inside surface 68 of the second member 62 of the credit/service card. Extra data 72 may be recorded. In the embodiment shown, the magnetic strip 54 runs along the back outside surface 50 of the second member 62.

Figure 7:
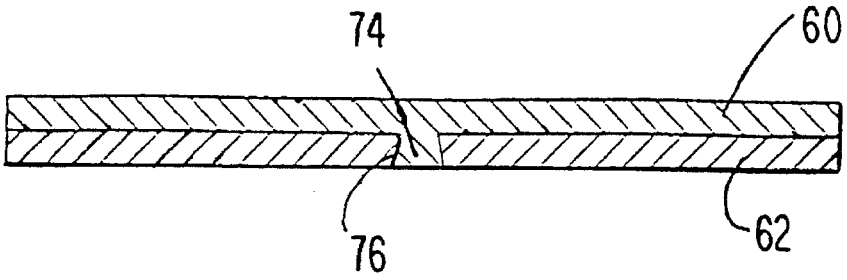
FIG. 7 shows a cross section of FIG. 4 along line 7.
Figure 8:
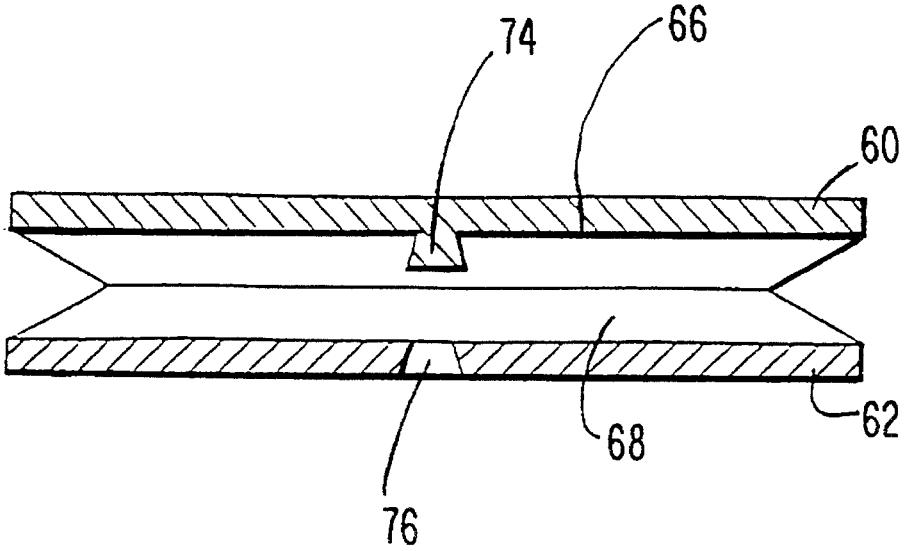
FIG. 8 shows the cross section of FIG. 7 in an open position.
Figure 9:
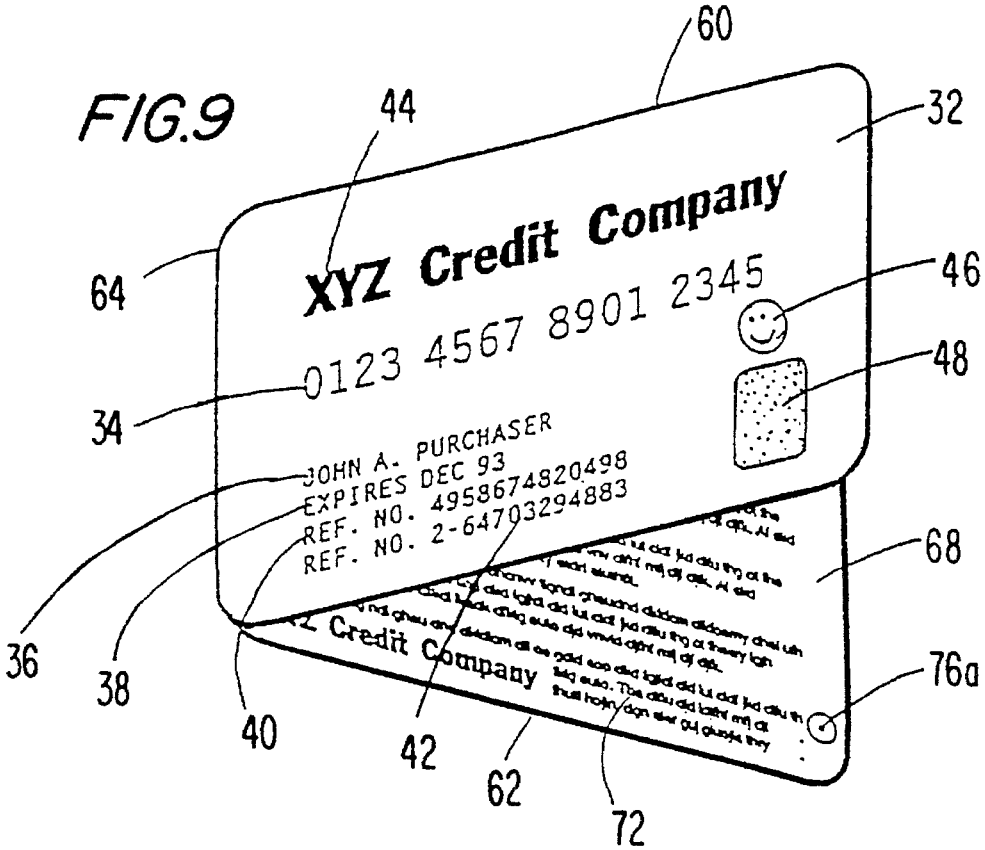
FIG. 9 shows another embodiment of the present invention wherein two card members are provided.
Figure 10:
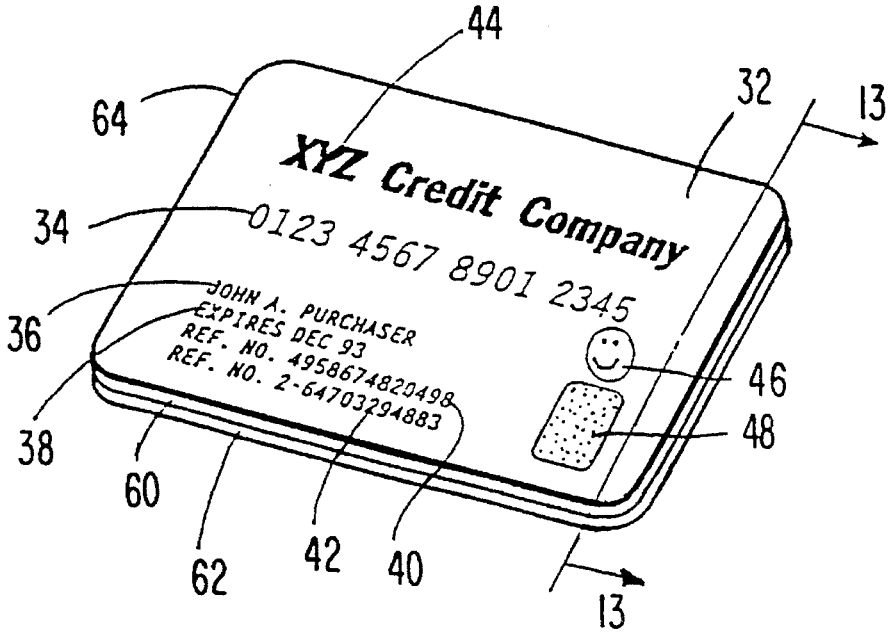
FIG. 10 shows the embodiment of FIG. 9 in a closed position.
Figure 11:
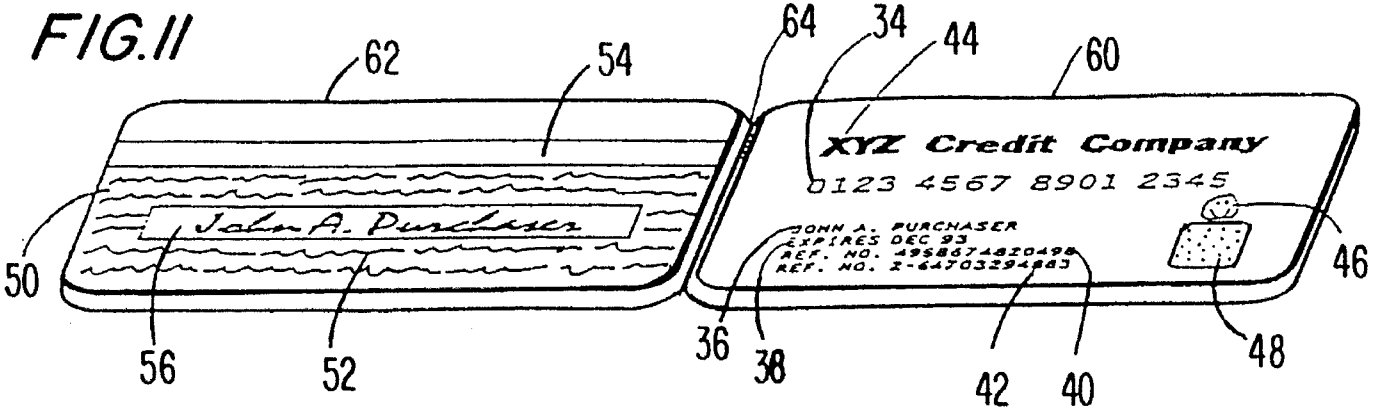
FIG. 11 shows the outside portion of the embodiment of FIG. 9 in a spread open, fiat position.
Figure 12:
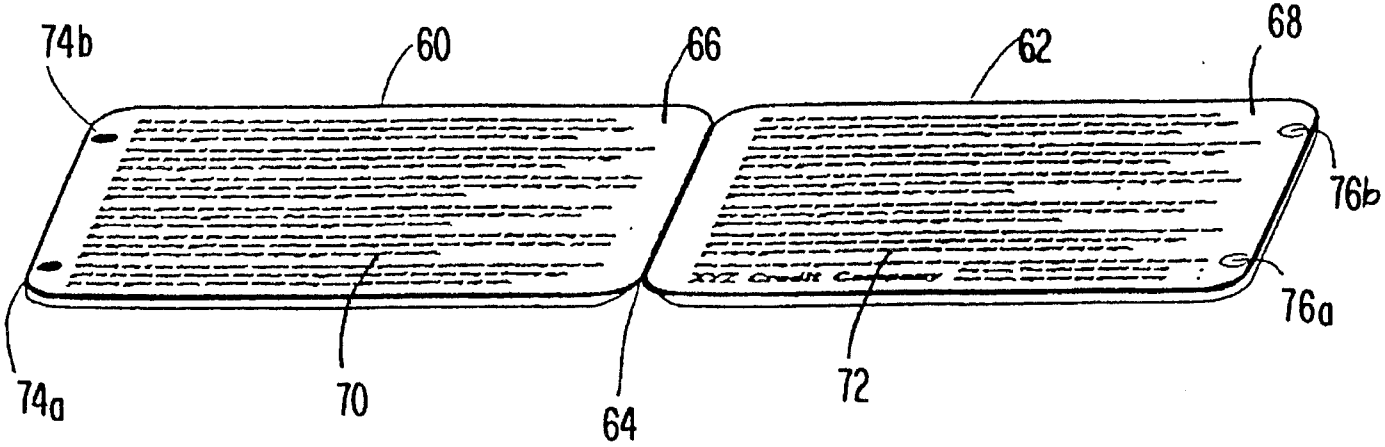
FIG. 12 is a back view of FIG. 11 showing the inside portion of the embodiment of FIG. 9 in a spread open, flat position.
Figure 13:
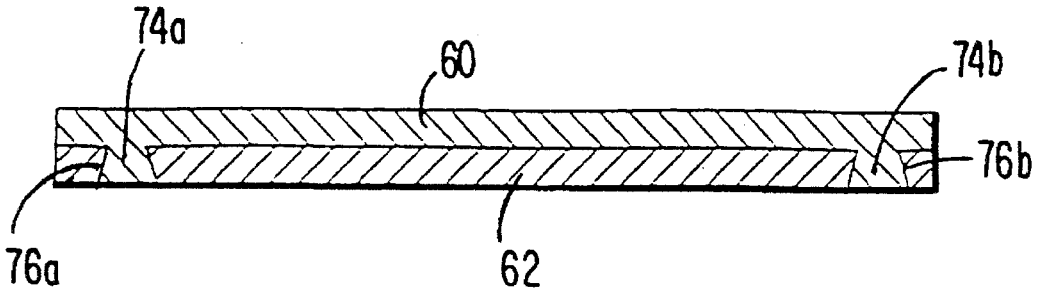
FIG. 13 shows a cross section of FIG. 10 along line 13.
Figure 14:
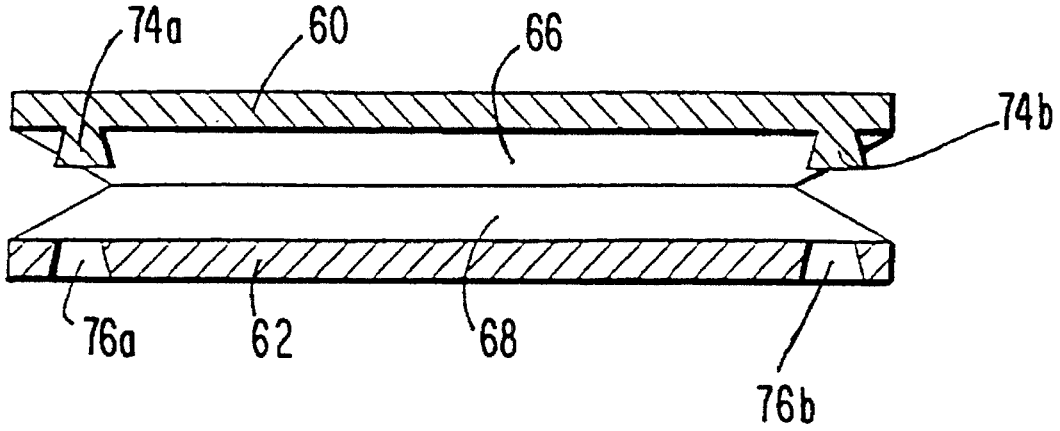
FIG. 14 shows the cross section of FIG. 13 in an open position.
Figure 15:
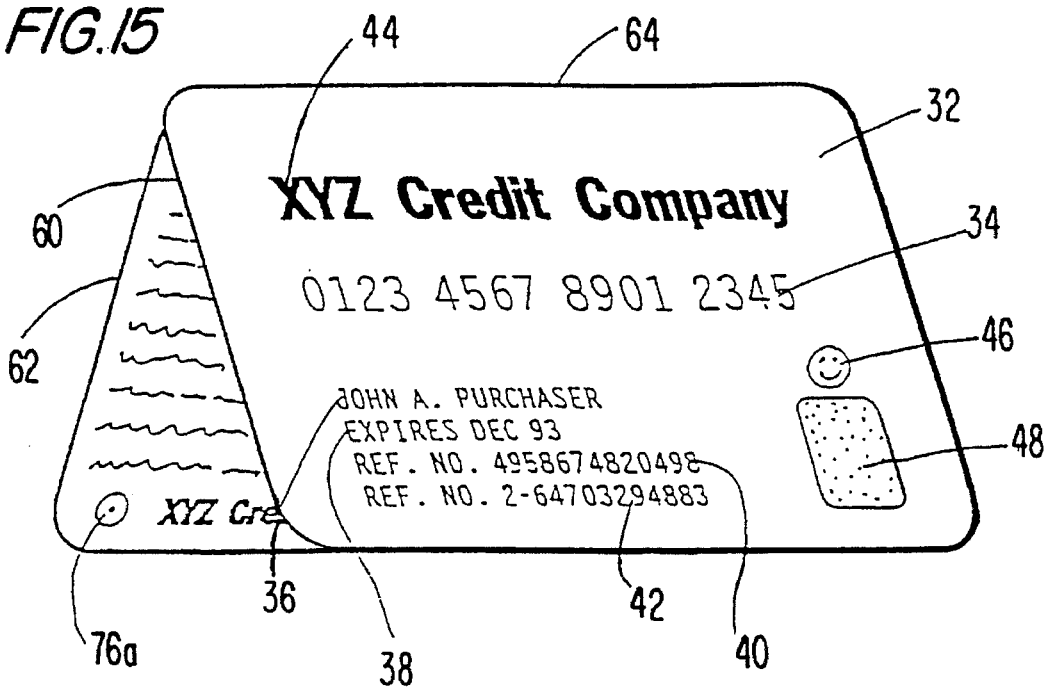
FIG. 15 shows another embodiment of the present invention wherein two card members are provided.
Figure 16:
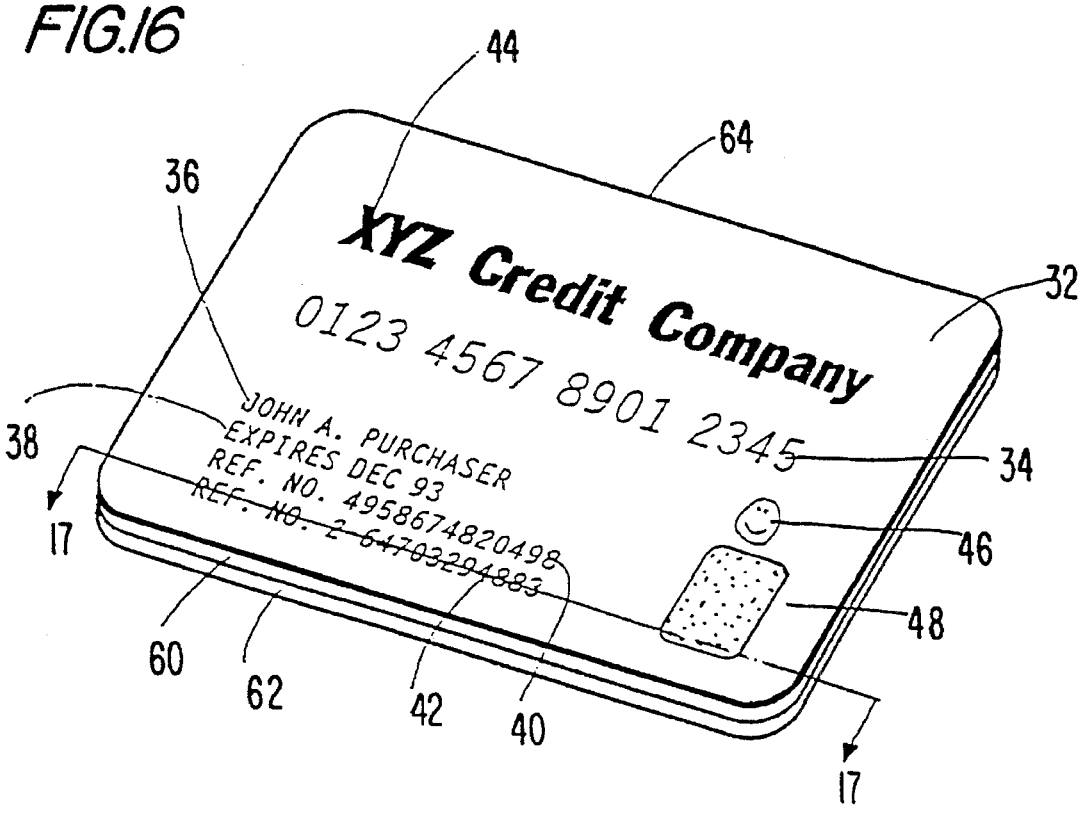
FIG. 16 shows the embodiment of FIG. 15 in a closed position.
Figure 17:
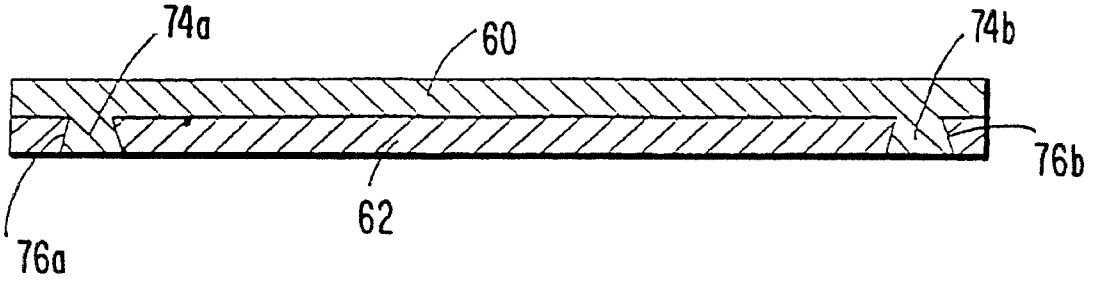
FIG. 17 shows a cross section of FIG. 16 along line 17.
Figure 18:
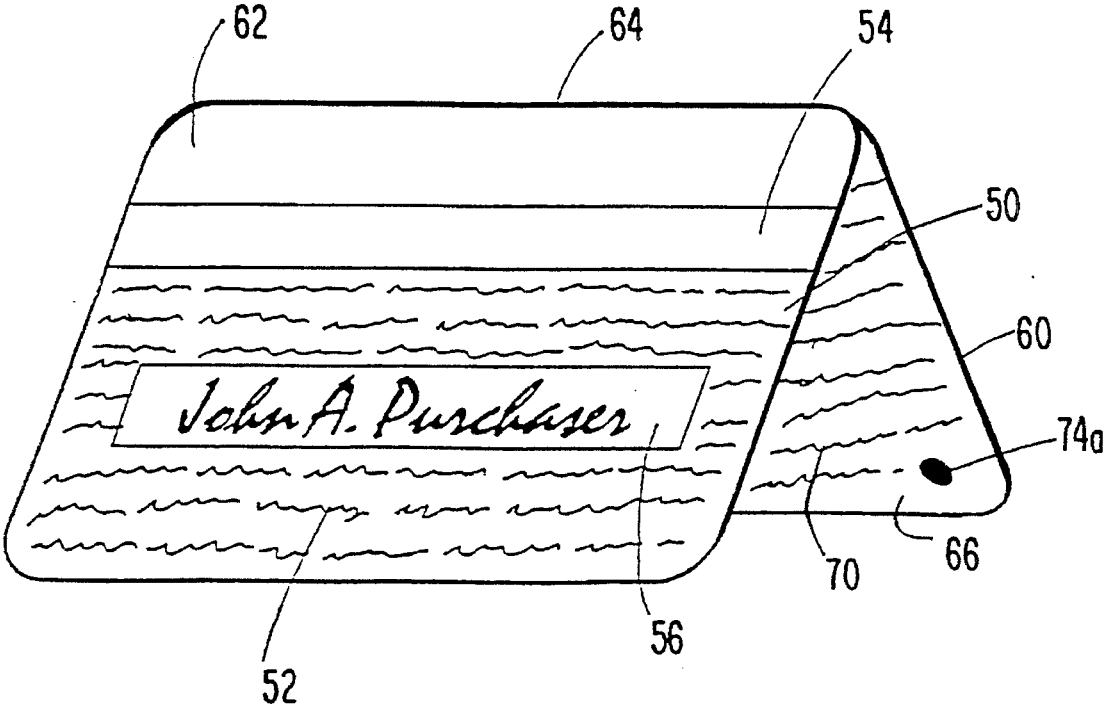
FIG. 18 shows a back view of the embodiment of FIG. 15.
Figure 19:
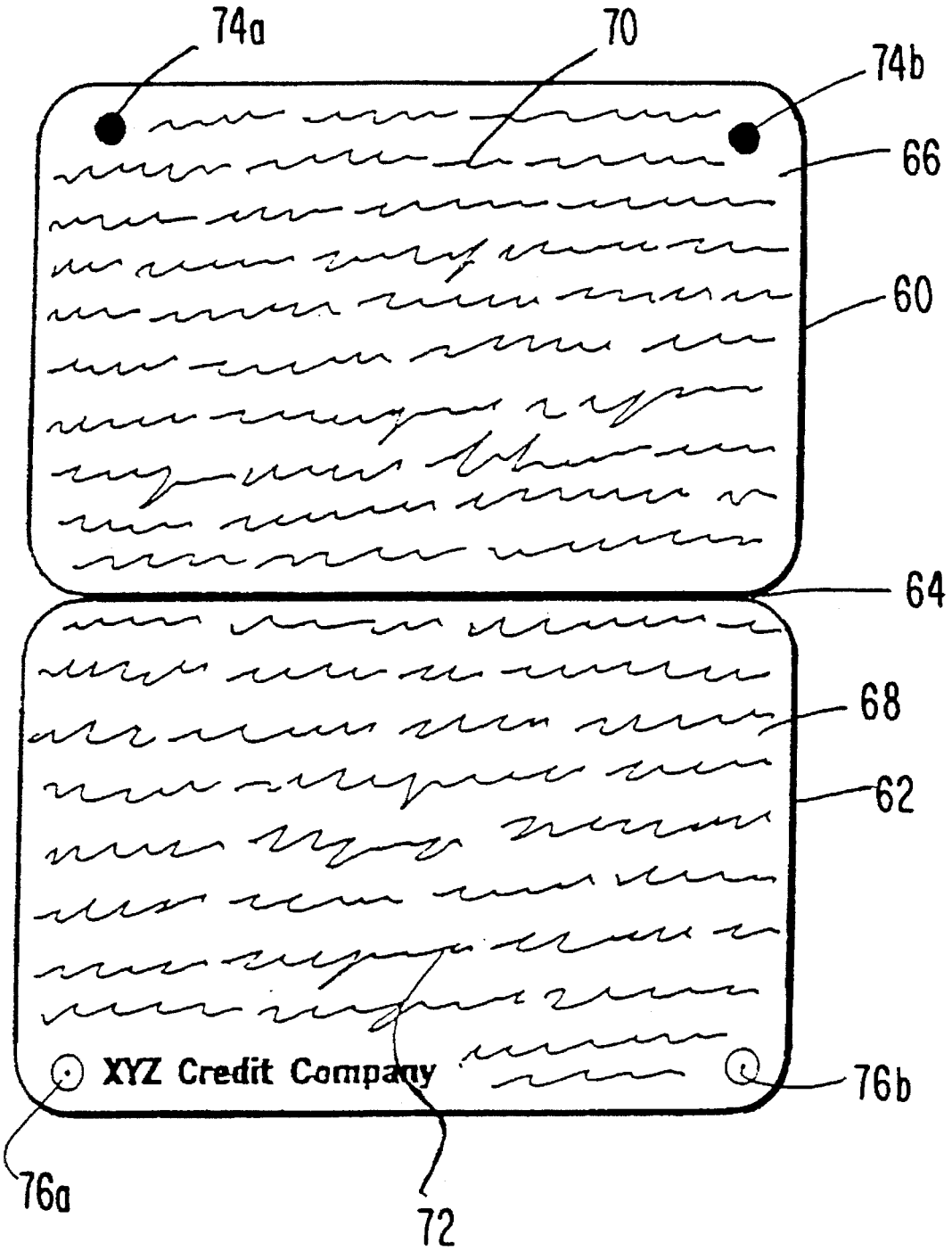
FIG. 19 shows the inside portion of the embodiment of FIG. 15 in a spread open, flat position.
Figure 20:
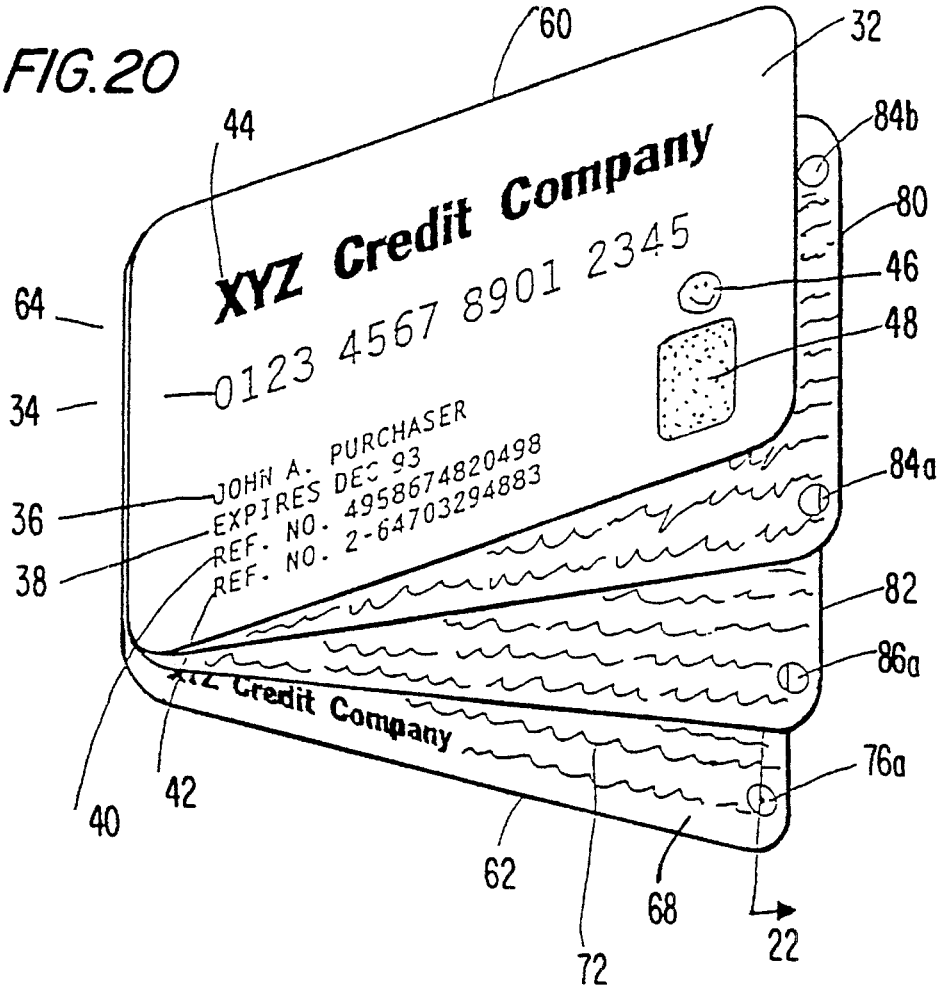
FIG. 20 shows an embodiment of the present invention wherein four card members are provided.
Figure 21:
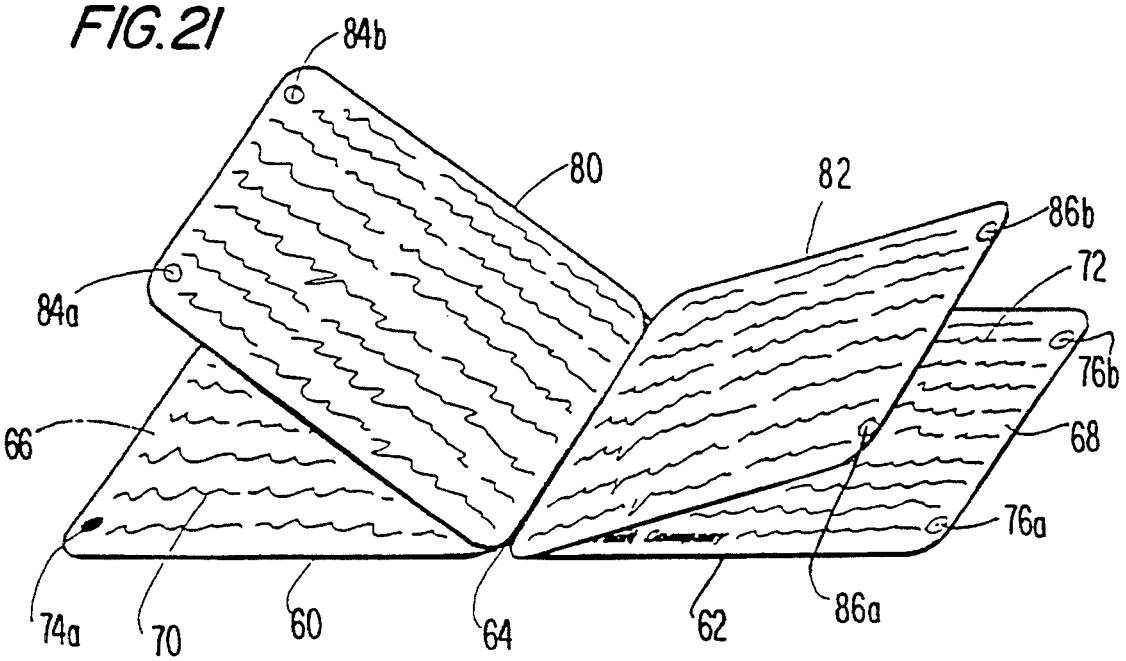
FIG. 21 shows the inside portion of the embodiment of FIG. 20 in a spread open position.
Figure 22:
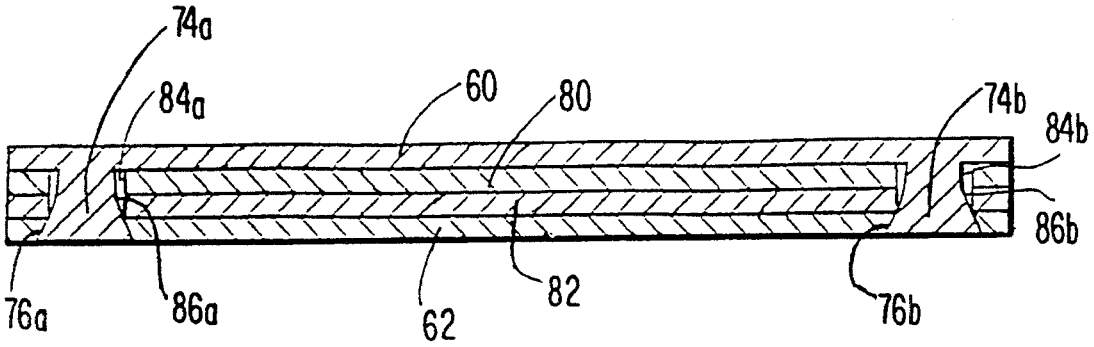
FIG. 22 shows a cross section of the embodiment of FIG. 20 in closed position.
Figure 23:
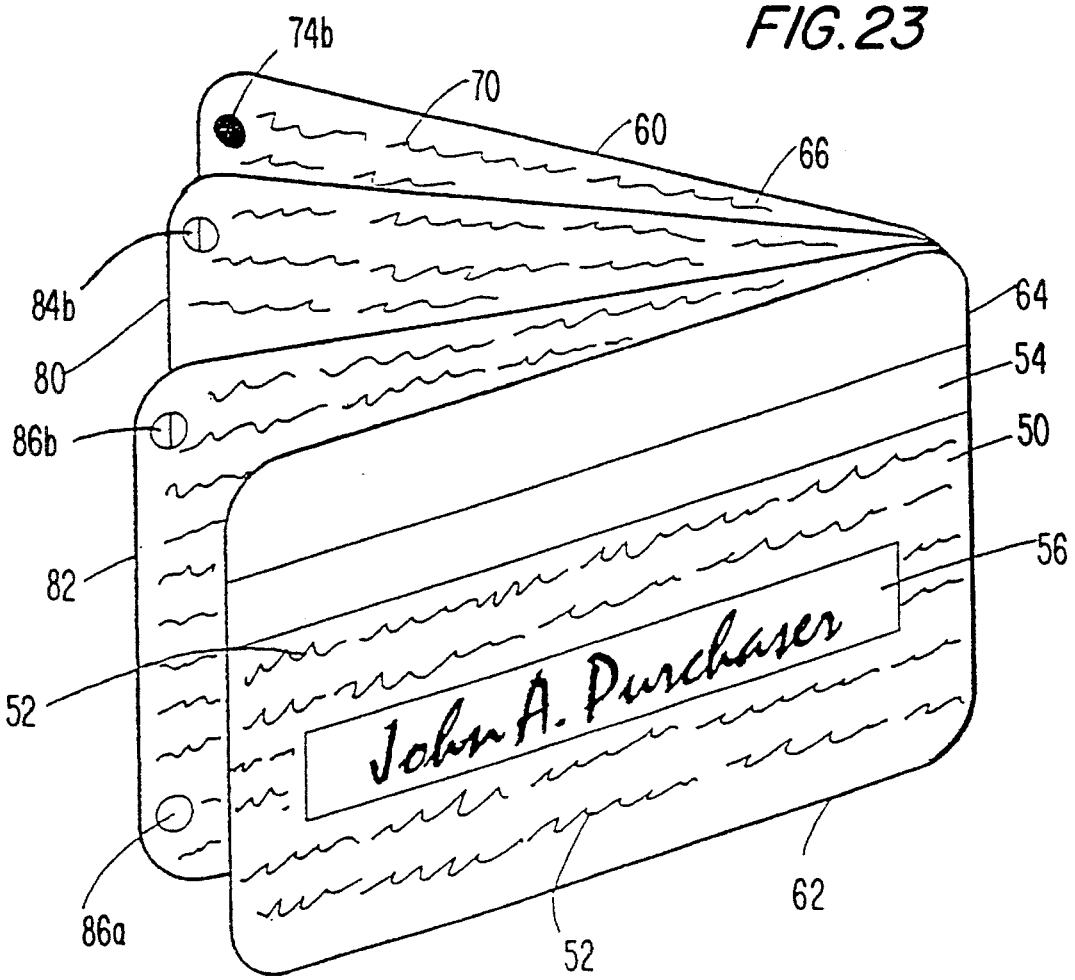
FIG. 23 shows the back view of the embodiment of FIG. 20.

This embodiment is held closed by a releasable and reclosable fastener such as a snap defined by male part 74 and female part 76. The male part 74 and female part 76 are shown schematically in FIGS. 3 through 6. More detail for an embodiment of the snap pans is provided in FIGS. 7 and 8. As can be seen, the male snap part 74 snaps into the female snap part 76 in a resilient manner. FIG. 8 shows the snap in an open position whereas FIG. 7 shows the snap on a closed position. As can be seen from FIG. 7, the profile of the snap on the second member 62 does not distort the surface 50 of the second member 62. This allows the card to be slid through existing credit/service card readers or placed in existing credit/service card machines, ATM machines or telephones without hinderance.

It is, of course, recognized that the releasable and reclosable fastener can also include hook means such as velcro™, interlocking zipper seals, self-sticking adhesive (particularly for temporary type cards), and the like.

Referring now to FIGS. 9 through 14, there is illustrated an embodiment similar to the embodiment of FIGS. 3 through 8. In these two embodiments like elements have been numbered consistently. As opposed to the single snap of FIGS. 3 through 8, the embodiment of FIGS. 9 through 14 has two snaps comprising male snap pans 74*a* and 74*b* and corresponding female snap parts 76*a* and 76*b*. The two snaps are spaced apart from one another and disposed on one side or edge of the card. This two snap arrangement more securely fastens the two members 60 and 62 together.

Referring now to FIGS. 15 through 19, there is illustrated an embodiment similar to the embodiment of FIGS. 9 through 14. In these two embodiments, like elements have been numbered consistently. As opposed to the position of the hinge 64 along the short edge of the credit/service card of FIGS. 9 through 14, the hinge in the embodiment of FIGS. 15 through 19 is formed on the longer edge of the credit/service card.

Referring now to FIGS. 20 through 23, there is illustrated an embodiment similar to the embodiment of FIGS. 9 through 14. In these two embodiments, like elements are numbered consistently. The embodiment of FIGS. 20 through 23 comprises four card members 60, 62, 80, 82.

Two snaps are provided, each with a male pan 74*a*, 74*b* and female part 76*a*, 76*b*. In order to accommodate the male end of the snaps 74*a*, 74*b*, there are provided two apertures 84*a*, 84*b* through the first inner card member 80 and two apertures 86*a*, 86*b* through the second inner card member 82. These apertures 84*a*, 84*b*, 86*a*, 86*b* are of an adequate diameter so that the male ends 74*a*, 74*b* of the snap can be placed therethrough. This card, like the previous embodiments has the thickness of a conventional credit/service card when closed.

The hinge 64 in this embodiment generally may be manufactured as described above with the addition of adding the inner members 80, 82. The inner members may be formed by welding or gluing an additional inner sheet (combination of 80 and 82) to the outer sheet (combination of 60 and 62) along their respective hinges. This hinge and connection may also be formed by molding.

It will be seen by those skilled in the art that any number of inner card members may be added to these embodiments.

An embodiment with only one inner card member may also be constructed. The invention is not limited to the number of members provided. This embodiment may also be hinged along its longer side as illustrated in the embodiment of FIGS. 15 through 19. This embodiment may also be construed of only one, or any number of snaps.

All of embodiments described herein my be constructed of well-known polymers known in the plastics industry. In the embodiment of FIGS. 20 through 23, the inner card members 80, 82 may be constructed of a different material, for example mylar, which is stronger and thinner than the material used to construct the outer card members 60, 62. The inner members 80, 82 may then be thinner than the outer members 60, 62. Alternately, all four members may be constructed of the same material and may be of the same thickness. In any case, the total thickness of the folded card should not exceed that of a conventional credit/service card.

Figure 24:
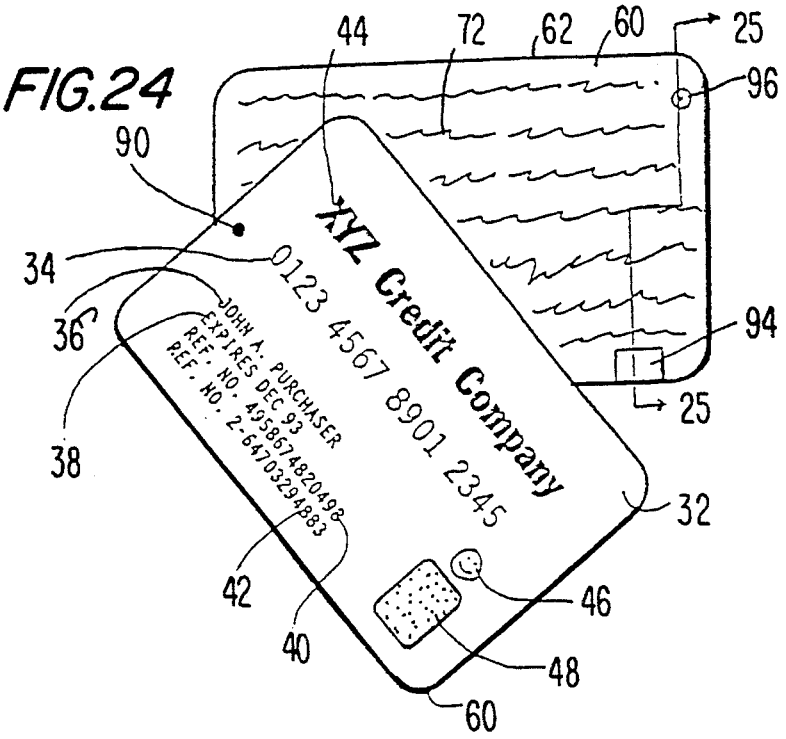
FIG. 24 shows another embodiment of the present invention wherein two card members are provided.
Figure 25:
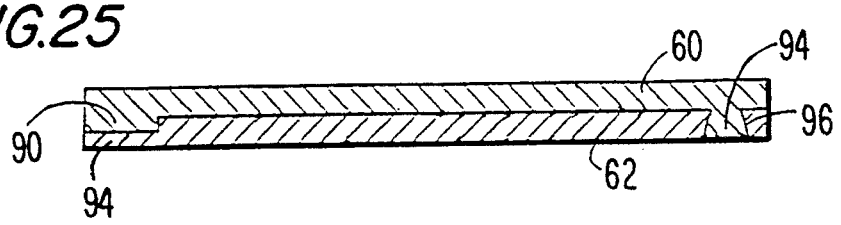
FIG. 25 shows a cross section of the embodiment of FIG. 24 in an closed position.
Figure 26:
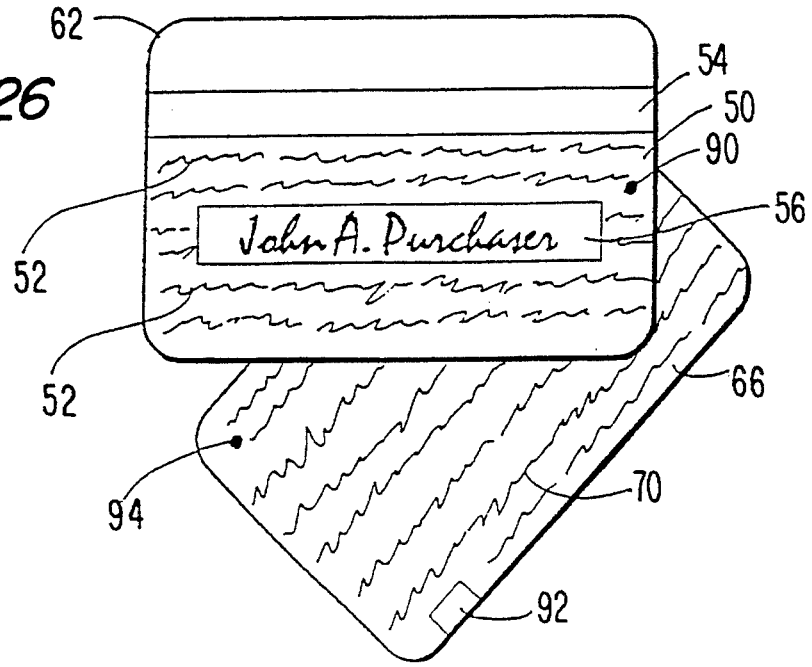
FIG. 26 shows a back view of the embodiment of FIG. 24.

Referring now to FIGS. 24 through 26 there is illustrated an embodiment similar to the two card member embodiments previously described. Like elements have been numbered consistently. Instead of a self-hinge 64, the two card members 60, 62 are attached together with a rivet 90 which forms a swing hinge 90. The rivet 90 may be constructed of metal or plastic using methods known in the art. The hinge 90 is constructed so as not to protrude from the outside surfaces 32, 50 of the card and thus does not hinder the card's use in conventional machines. There is also provided a mortised side stop with a male portion 92 and female portion 94 for preventing the card from swinging too far. There is also provided a snap with a male part 96 and a female part 98 for holding the card in the closed position.

The card may also be held in place by replacing the female snap part 98 with a dimple or indentation and replacing the male snap part 96 with a protrusion designed to fit into the aforementioned indentation. The protrusion and indentation will frictionally hold the card in a closed position. The mortised side stop may also be eliminated and thus the snap alone would hold the card closed. For this purpose, an additional snap may be added to this embodiment. As with the other embodiments this embodiment may also be formed of three, four, five or any number of card members so that the card members form a thickness no greater than a conventional credit/service card.

As can be seen, all of the described embodiments provide for greater usable surface area for the recordation and display of additional information, without taking away from the performance of the card in relation to existing equipment in the industry. Additional surface area is provided on the inside surfaces of the card. If the user needs to access this information, he can open the card by pulling the two (or more) members apart and thus releasing the snap(s). When finished viewing the information, the card may be closed by pressing the card members together and thereby engaging the snap(s). When closed, the dimensions of the card are approximately equal to that of a conventional card and can therefore be used in existing equipment.

Figure 27A:
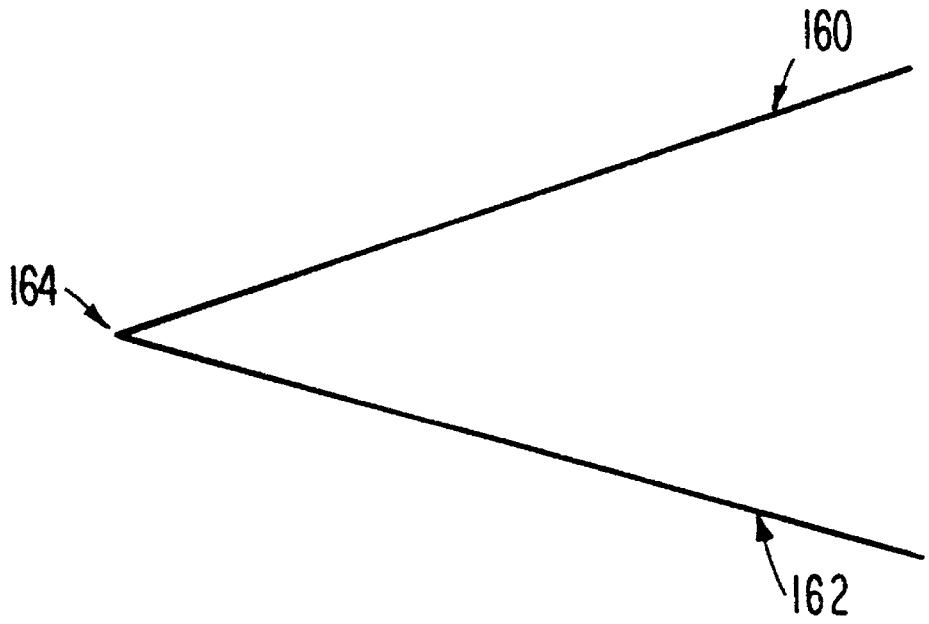
FIGS. 27*a* and 27*b* shows a cross section of a four-sided card and hinge arrangement.
Figure 27B:
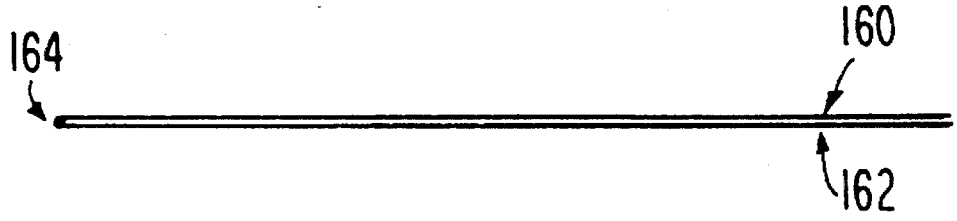
Figure 28A:
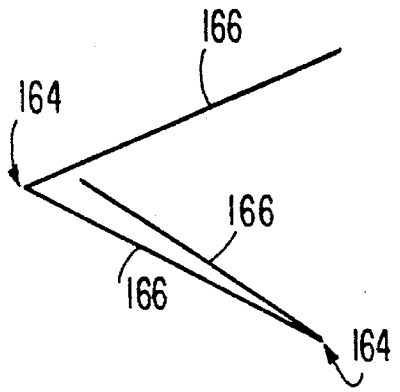
FIGS. 28*a*, 28*b*, and 28*c* show a cross section of a six-sided card and hinge arrangement.
Figure 28B:
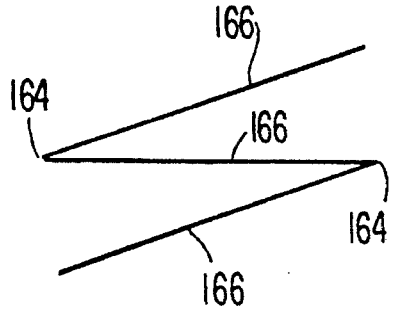
Figure 28C:
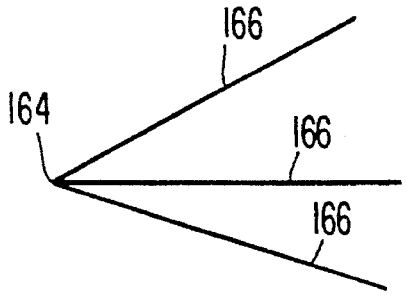
Figure 29A:
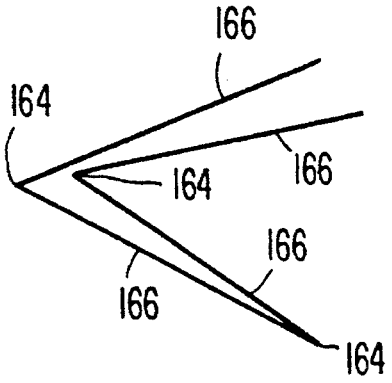
FIGS. 29*a*, 29*b*, and 29*c* show a cross section of a eight-sided card and hinge arrangement.
Figure 29B:
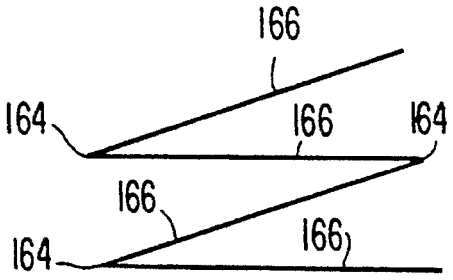
Figure 29C:
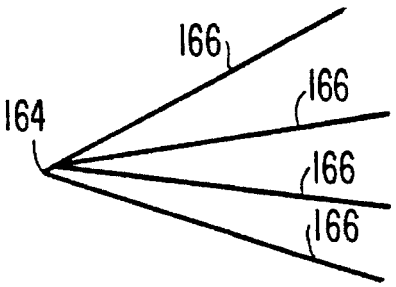
Figure 30A:
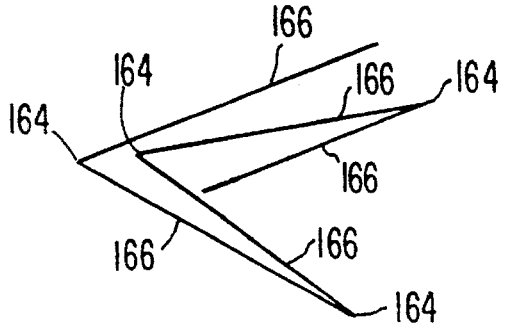
FIGS. 30*a*, 30*b*, and 30*c* show a cross section of a ten-sided card and hinge arrangement.
Figure 30B:
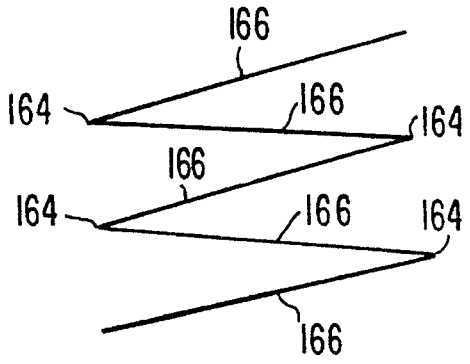
Figure 30C:
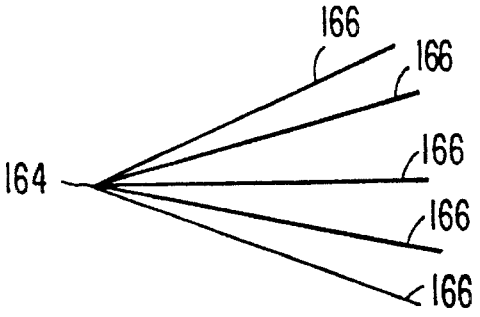
Figure 31A:
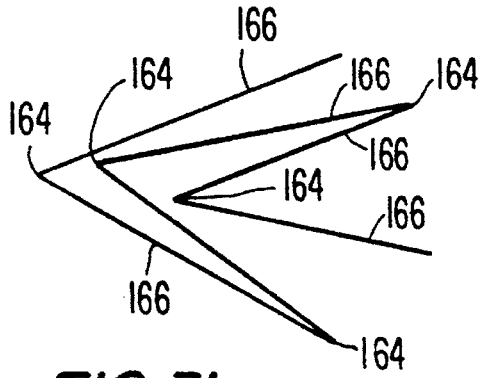
FIGS. 31*a*, 31*b*, and 31*c* show a cross section of a twelve-sided card and hinge arrangement.
Figure 31B:
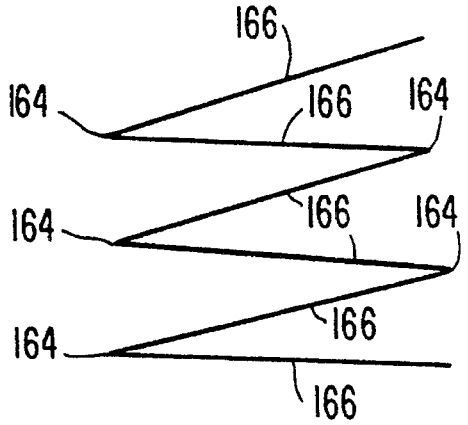
Figure 31C:
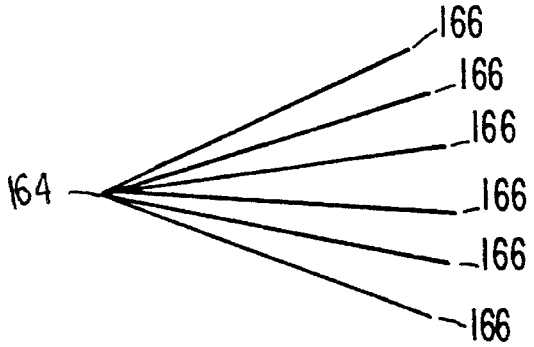

Referring now to FIGS. 27 through 34, there is depicted an additional embodiment of the present invention. As shown in FIG. 27, the credit/service card has two members (four-sides), a first member 160 and a second member 162. The members 160, 162 are attached together by a hinge means 164, wherein the hinge means 164 includes a means for self-closing and/or self-securing the first and second card member in a closed position.

One embodiment of a self-closing and self-securing hinge means is a hinge made of a plastic having shape memory. A plastic having shape memory can be deformed from its initial shape by application of physical pressure or force, and yet the plastic will return to its initial shape when the physical pressure is released. Shape memory can be imparted or set into a plastic by heat and/or pressure while in the desired initial shape. Plastics which are capable of retaining shape memory include but are not limited to polyvinyl chloride, polyethylene terephtalate, polystyrene, polypropylene, polyethylene, and the like.

In this embodiment, the credit/service card can be made from a single piece of shape memory plastic, configured into the desired initial shape, then set by heat and/or pressure. Thus, referring to FIGS. 27*a* and 27*b*, the first card member 160, second card member 162, and hinge means 164 would all be formed from a single piece of shape memory plastic, and set into a closed position shown in FIG. 27*b*.

Additionally, the credit/service card can be made from separate types of plastic, wherein the hinge means 164 can made from shape memory plastic set into a closed position, and the first card member and second card member are made from a different material and attached to the hinge.

In a preferred embodiment, the card members are each between a thickness of about 5 mm and 20 mm.

It is understood that self-closing and self-securing hinge means could include at least one interlocking micro hinge (similar to a door hinge) having a self-securing means releasable upon a pressure force away from the closed position and which has a biasing means to self-close the hinge into the closed position. A non-biased interlocking micro hinge having a self-securing means without a biasing means would constitute a self-securing hinge means.

FIGS. 28*a–c*, 29*a–c*, 30*a–c*, 31*a–c* show multiple hinges 164 and multiple card members (each generically numbered 166) arranged to yield six-, eight-, ten-, and twelve-sided credit/service cards, respectively.

Figure 32:
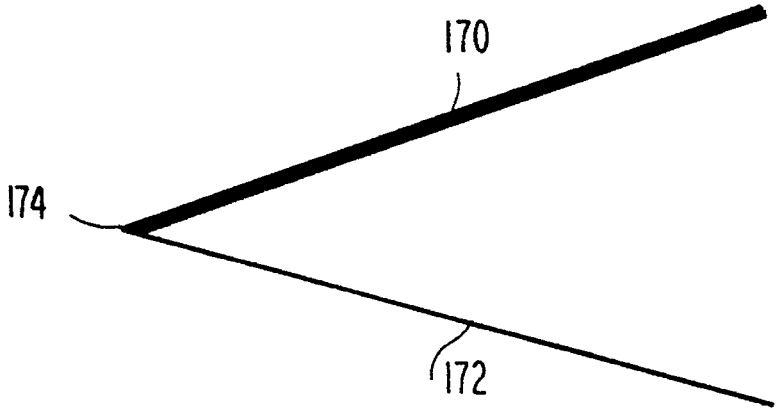
FIG. 32 shows a cross section of a four-sided card and hinge arrangement where the cards are of different thicknesses.
Figure 33A:
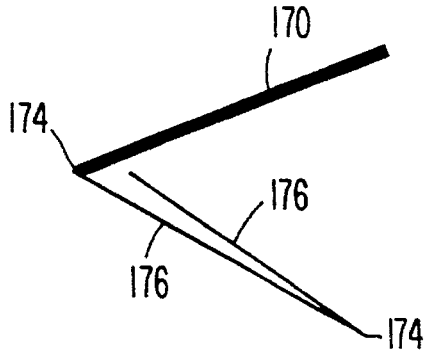
FIGS. 33*a*, 33*b*, 33*c*, 33*d*, 33*e* and 33*f* show a cross section of a four-sided card and hinge arrangement where the cards are of different thicknesses.
Figure 33B:
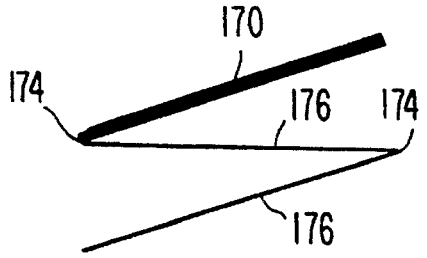
Figure 33C:
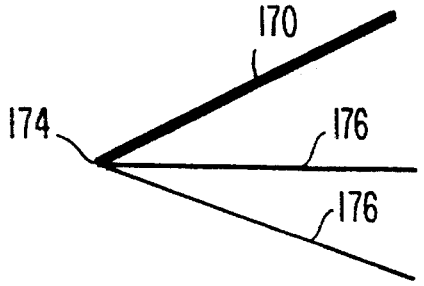
Figure 33D:
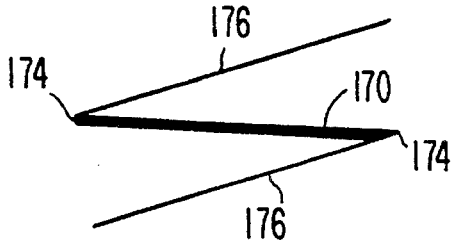
Figure 33E:
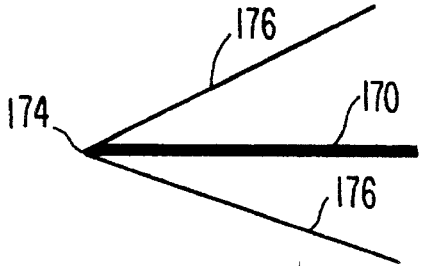
Figure 33F:
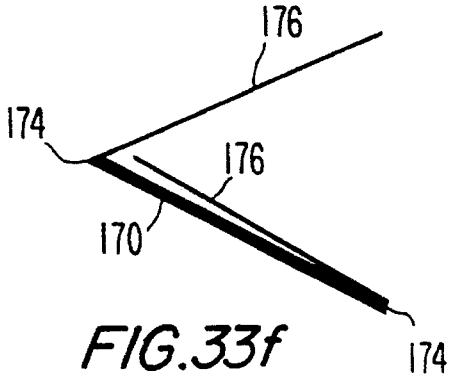

Referring now to FIG. 32, there is depicted an additional embodiment of the present invention. As shown in FIG. 32, the credit/service card has two members (four-sides), a first card member 170 and a second card member 172. The members 170, 172 are attached together by a hinge means 174. As shown, first card member 170 is dimensionally thicker than second card member 172. This allows for the use of the credit/service card in different type of machinery used for scanning and reading magnetic information on the card. For example, the thickness of first card member 170 together with second card member 172 can be the proper thickness for use in standard credit card readers. However, when in an opened position the thinner second card member 172 can be used in a pre-paid commuter fare card reader, such as in a subway, whose magnetic strip reader is generally set up to read magnetic information on thin cards (general a paper card). Thus, a credit/service card can be designed to function in a variety of readers which require differing card thicknesses. In a preferred embodiment, the first card member 170 is about 20 mm and the second card member 172 is about 10 mm.

Hinge means 174 can include any hinging means discussed above. However if the hinge means does not include a means for self-closing and/or self-securing the first card member 170 and second card member 172 in a closed position, the first card member 170 and second card member 172 can also include a releasable and reclosable fastener holding the first card member 170 to the second card member 172 as discussed above.

FIGS. 33*a–f*, for example purposes, show multiple hinges 174 and two card members of equal thickness (each generically numbered 176) arranged with a thicker card member 170 to yield six-sided credit/service cards of various configurations. In a preferred embodiment, the card members are made in about 20 mm, 10 mm, and 5 mm thicknesses.

Figure 34:
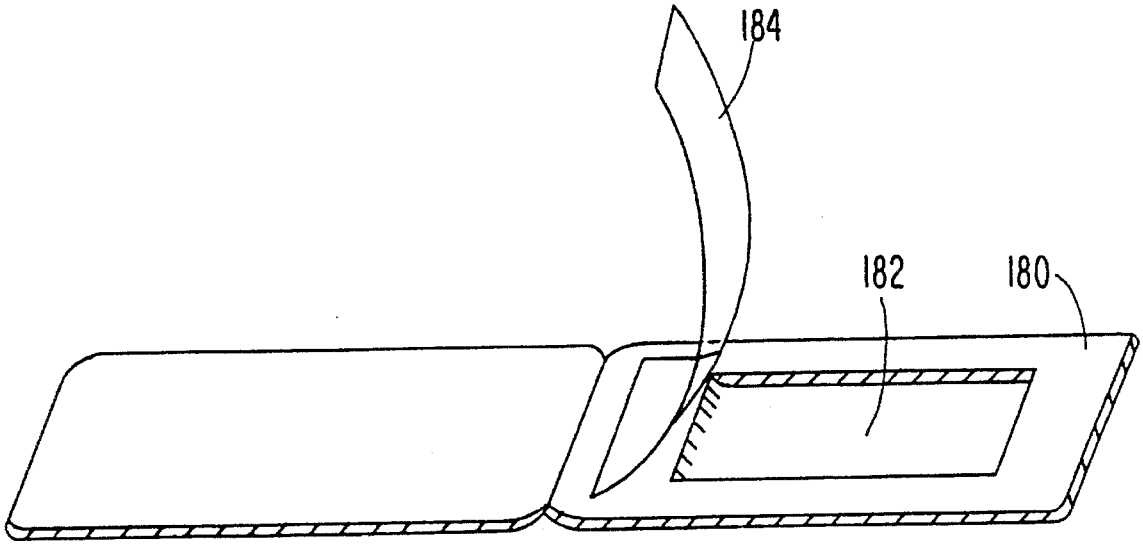
FIG. 34 shows a credit/service with a housing.

Referring now to FIG. 34, there is depicted an additional embodiment of the present invention. As shown in FIG. 34, the credit/service card has at least one card member 180 have a means for receiving and retaining a personal photograph or an identification means such as an identification photograph, or a computer or visual readable means of identification, e.g. voice chip, photograph chip, finger- or other digit-print chip, or eye or retina information chip for scanning. FIG. 34 depicts a recessed compartment 182 in card member 180 and a clear self-adhesive laminate 184 to cover and secure the photograph or identification means when placed in the recessed compartment 182. It is of course understood that any number of know means of housing and securing the photograph or identification means could be used in the present invention.

The foregoing description of the exemplary and preferred embodiments of the present invention has been presented for purposes of illustration and description. They are not intended to be exhaustive or to limit the invention to the precise forms disclosed, and obviously many modifications of the variations are possible in light of the above teachings. The embodiments were chosen and described in order to best explain the principle of the invention and its practical applications and to thereby enable others skilled in the art to best utilize the invention in various embodiments and with various modifications as are suitable to the particular use contemplated. It is intended that the scope of the invention be defined by the following claims, including all equivalents.

I claim:

1. A method of using a credit/service card comprising:

a) providing a credit/service card with increased surface area which comprises a first card member and a second card member;

b) hinging the first card member to the second card member wherein in a closed position the first card member is releasably fastened to the second card member; and c) using the credit/service card in a machine which reads conventional credit/service cards so as to read information from the card.

2. A method of using a credit/service card of claim 1 in which the card is used in a machine by scanning and reading magnetic information on the card.

3. A credit/service card comprising:

a first card member;

a second card member; and a self-closing and self-securing hinge means connecting the first card member to the second card member.

4. The credit/service card of claim 3 wherein the first card member and second card member have a combined thickness in a closed position approximately equal to that of a conventional credit/service card.

5. The credit/service card of claim 3 wherein the self-closing and self-securing hinge means is formed from a shape memory plastic.

6. The credit/service card of claim 3 wherein the first card member, the second card member, and the self-closing and self-securing hinge means are all formed from a single piece of shape memory plastic.

7. The credit/service card of claim 3 wherein the first card member and the second card member have different thicknesses.

8. The credit/service card of claim 7 wherein the first card member has a thickness of about 20 mm and the second card member has a thickness of about 10 mm.

9. The credit/service card of claim 3 further comprising at least one additional card member attached at the hinge of the first card member to the second card member.

10. The credit/service card of claim 3 further comprising at least one additional card member attached to the first card member or the second card member or to an additional card member.

11. The credit/service card of claim 3 further comprising a means for housing and securing a photograph or identification means within a card member.

12. The credit/service card of claim 3 further comprising an identification means which includes a voice chip, a photograph chip, a finger- or other digit-print chip, or an eye or retina information chip for scanning.

* * * * *